United States Patent [19]

Hicks et al.

[11] Patent Number: 4,941,593

[45] Date of Patent: Jul. 17, 1990

[54] CLEANING SYSTEM FOR BEVERAGE DELIVERY CONDUITS

[76] Inventors: Robert C. Hicks, 273 Green Hill Rd., Telford, Pa. 18969; Raymond M. Benyaker, 117 Cantebury La., Lansdale, Pa. 19446

[21] Appl. No.: 295,760

[22] Filed: Jan. 11, 1989

[51] Int. Cl.[5] ..... B67D 1/08

[52] U.S. Cl. ..... 222/148; 222/144.5; 137/240; 134/169 C

[58] Field of Search ..... 222/148, 135, 144.5, 222/129, 190, 23, 154; 137/240, 237, 238, 246.11, 246; 134/169 L, 169 C; 73/700

[56] References Cited

U.S. PATENT DOCUMENTS

| | | | |
|---|---|---|---|
| 3,441,034 | 4/1969 | Burks | 134/169 C |
| 4,465,210 | 8/1984 | Iwawami | 222/148 |
| 4,516,596 | 5/1985 | Sugisawa et al. | 222/148 |
| 4,527,585 | 7/1985 | Mirabile | 222/148 |

FOREIGN PATENT DOCUMENTS

| | | | |
|---|---|---|---|
| 2462387 | 7/1979 | France | 222/148 |

*Primary Examiner*—Michael S. Huppert
*Assistant Examiner*—Kenneth Noland

[57] ABSTRACT

Cleaning equipment is connected to automatically clean conduits which deliver beer from a keg to a spigot. An operator may manually commence the cleaning operation by controlling valves connected to the keg and to a source of water. The spigot is then manually opened by the operator to permit the water to flow through the conduits being cleaned and dispensed at the spigot. The water pressure at the entrance to the conduits creates a vacuum effect to cause a chemical solution to be mixed with the water in accordance with the amount of water pressure. A gauge measures the water back pressure at the entrance to the conduits. The amount of chemical concentration in the solution may be determined when the cleaning equipment is installed from systems involving different numbers of conduits having different back pressure levels.

8 Claims, 2 Drawing Sheets

FIG. 2
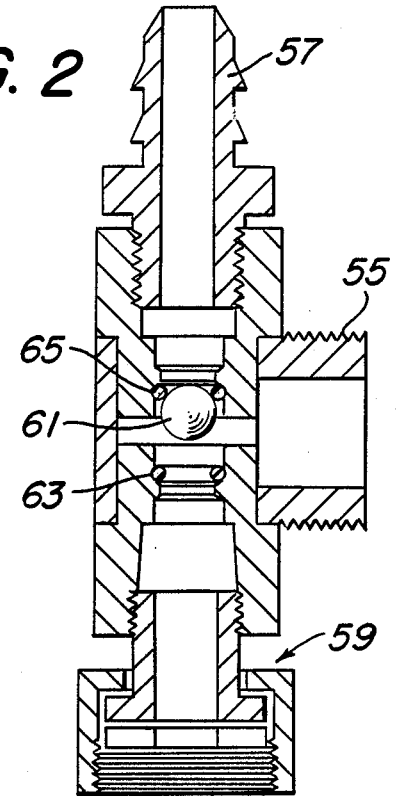
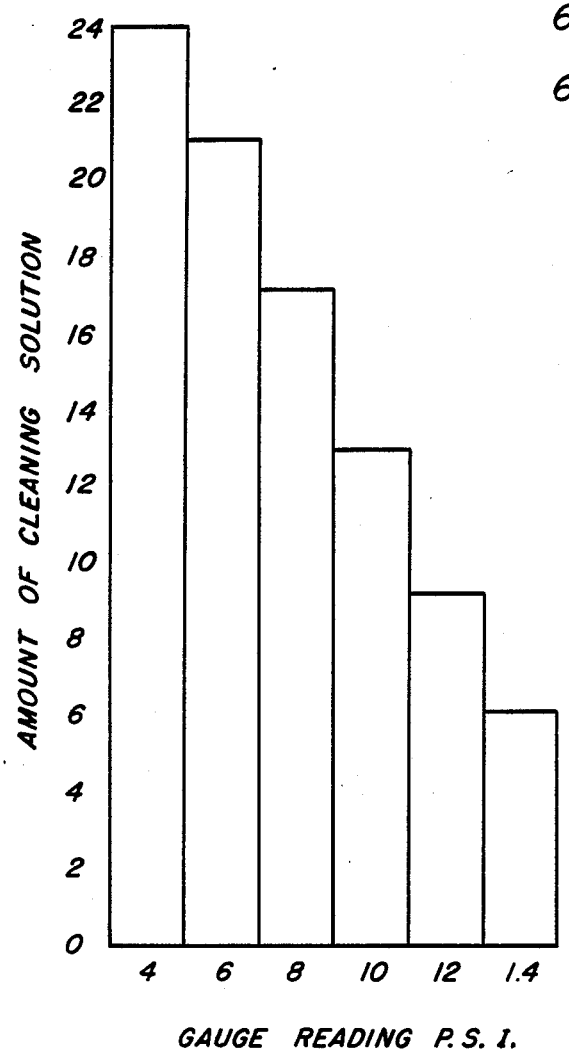
FIG. 3

CLEANING SYSTEM FOR BEVERAGE DELIVERY CONDUITS

BACKGROUND OF THE INVENTION

A beverage delivery system may include a source of beverage such as a keg of beer, which maintains the beer under pressure by carbon dioxide. Conduits and coils generally carries the beer from the keg to a discharge device such as a manually operated spigot.

Beer in kegs are often stored at relatively low temperatures in refrigerated areas. In taverns where the beer is served to customers conduits or pipes are used to connect the kegs to the spigots in the customer areas. Changes in pressures and temperatures while the beer is ready for dispensing tends to change the taste and aroma of beer and special care generally is taken to avoid these changes.

Beverage delivery systems involving beer and other beverages must be maintained as clean as possible to comply with health standards. In many cases, state laws have been enacted requiring coils and the connecting conduits or pipes to be periodically cleaned. One reason for the strict sanitation requirement in connection with beer delivery systems is that some of the materials in beer may chemically react to cause particle precipitations in the delivery conduits, which tend to affect the taste of the beer and possibly lead to health problems.

Beverage cleaning systems have been disclosed in Jones U.S. Pat. No. 1,993,371; Warcup U.S. Pat. No. 2,458,230; Audia U.S. Pat. No. 2,645,379; Hilts U.S. Pat. No. 3,036,741; Mirabile U.S. Pat. Nos. 4,527,585,and 4,572,230 and Doak U.S. Pat. No. 4,582,226.

In some of these patents cleaning means are disclosed to clean the delivery conduits and other parts of a beverage delivery system.

In some of these patents the normal beer delivery is discontinued during the cleaning operation. In some such cleaning systems, chemical powders have been mixed with water to form a cleaning solution which is forced through conduits and other devices to perform a cleaning operation when the delivery system is shut down. For example, Warcup U.S. Pat. 2,563,385 uses apparatus for controlling the concentration of a chemical cleaning fluid in water. An operator pushes a control valve to supply the chemical cleaning fluid to the water line.

The Audia U.S. Pat. No. 2,645,379 uses a gravity flow valve to control the amount a cleaner solution which is added to water in a tank.

Mirabile U.S. Pat. No. 4,527,585 discloses hot water under pressure siphoning cleaning solution from a reservoir. A pump is operated to cause vacuum in the conduits. The vacuum caused by the pump, together with the pressure of the incoming hot water, causes turbulance which carries the cleaning solution into the conduits.

Chemical solutions have been mixed with pressurized water flowing from a conventional source to clean conduits, as illustrated in the U.S. Pat. No. 4,527,385.

Generally, a chemical solution used for cleaning comprises a mixture of water and a chemical powder which is dispensed in the main water supply flowing through the cleaning system. The concentration or amount of the chemical powder mixed with water is dependent upon the particular system involved. For example, different concentrations of the chemical powder are generally required for different systems, with the concentrations being determined by the size of the dispensing system involved, the number of conduits to be cleaned, the length of time allotted to the cleaning operations and other factors.

Different dispensing systems generally produce different back pressures when different numbers and lengths of conduits are involved. These different back pressures effect the pressure of the main flow of water used in the cleaning system. To compensate for different back pressures, the concentration of the chemical mixed with the water in the cleaning solution may require changes. The present invention relates to this problem and is directed towards providing a relatively simple automatic cleaning system which may be easily attached to different dispensing systems involving different back pressures resulting from different number or sizes or the conduits in a system.

The systems described in the cited patents have generally been designed to accommodate a particular type of beverage delivery system and are not readily adaptable to accommodate different systems involving different number of beverage sources, conduits and spigots. Major structural changes in the cleaning equipment would generally be required when changes in the delivery systems are involved. This is primarily caused by different numbers of conduits resulting in different back pressures in the water passing to the conduits when the water source of pressure is constant.

Some of the patents mentioned above involving the use of cleaning fluids do not have the versatility necessary to accommodate different systems without resorting to major structural changes in the delivery system.

The present invention is directed to providing a simple, inexpensive system with a minimum number of parts, which does not require changes in any of the mechanical parts when different delivery systems are involved. This is accomplished by measuring the water pressure levels at the point that the water enters the delivery conduits during a cleaning operation and determining the chemical concentration of the cleaning solution used to give maximum cleaning while still economizing on the amount of the chemical in the cleaning solution. The cleaning system is adaptable to vastly different delivery systems with no changes being required in either the delivery or cleaning systems after the initial installation.

OBJECTS OF THE INVENTION

It is an object of this invention to provide improved means for cleaning conduits in a beverage dispensing system.

It is further object of this invention to provide an improved means for automatically cleaning a beverage dispensing system after it has been started by an operator.

It is a further object of this invention to provide improved means for quickly switching between cleaning and beverage dispensing operations.

It is still a further object of this invention to provide an improved cleaning system which may be readily installed in different types of existing beverage dispensing systems without changing parts in any of the dispensing systems.

It is still a further object of this invention to provide an improved cleaning system which is readily installed in existing beverage dispensing arrangements and which involves a minimum number of parts and expense of installation.

It is still a further object of this invention to provide an improved cleaning means for cleaning conduits, between a source of beverage and a dispenser, utilizing a conventional source of pressurized water to automatically control the amount of an additive cleaning solution in accordance with the back pressure created in the conduits during a cleaning operation.

It is still a further object of this invention to provide means for cleaning conduits in a plurality of beverage dispensing arrangements each having a plurality of dispensers connected through the conduits to a plurality of beverage sources.

It is still a further object of this invention to provide an improved cleaning system which utilizes a conventional water source to provide unlimited water for use in cleaning and rinsing.

BRIEF SUMMARY OF THE INVENTION

In accordance with the present invention, a system is provided for cleaning conduits which deliver a beverage, such as beer, from one or more beverage sources or kegs to one or more dispensers or spigots. When it is time to periodically clean the conduits, an operator closes a valve which prevents the beverage from flowing to the spigots, opens one or more spigots and then connects a conventional water source to the conduits to cause water flow therethrough. The water pressure creates a form of vacuum or venturi effect at an area leading to a cleaning solution causing the flowing water to be mixed with the cleaning solution, in accordance with the water back pressure as it enters the conduits. A pressure gauge is connected to measure the pressure of water entering the conduits during a cleaning operation so that the amount of cleaning solution mixed with the water may be determined at installation so that the concentrations of the cleaning solution may be adjusted to compensate for different water back pressures. All the spigots are closed to permit the cleaning solution to remain in the conduits to permit the solution to penetrate and loosen undesired particles for a period of time after which the spigots are opened to flush the cleaning solution and rinse the conduits with clear water.

Other objects and advantages of the present invention will be apparent and suggest themselves to those skilled in the art from a reading of the following specifications and claims taken in conjunction with the accompanying drawings.

BRIEF DESCRIPTION OF THE DRAWINGS

FIG. 2 is a cross sectional view of one of the shuttle valves taken through the center looking into the page, and FIG. 3 is a chart illustrating the precise amounts of cleaning solution used for different pressure levels when different numbers of conduits are used with a different number of spigots, in a beer distributing system.

DESCRIPTION OF THE INVENTION

Figure 1:
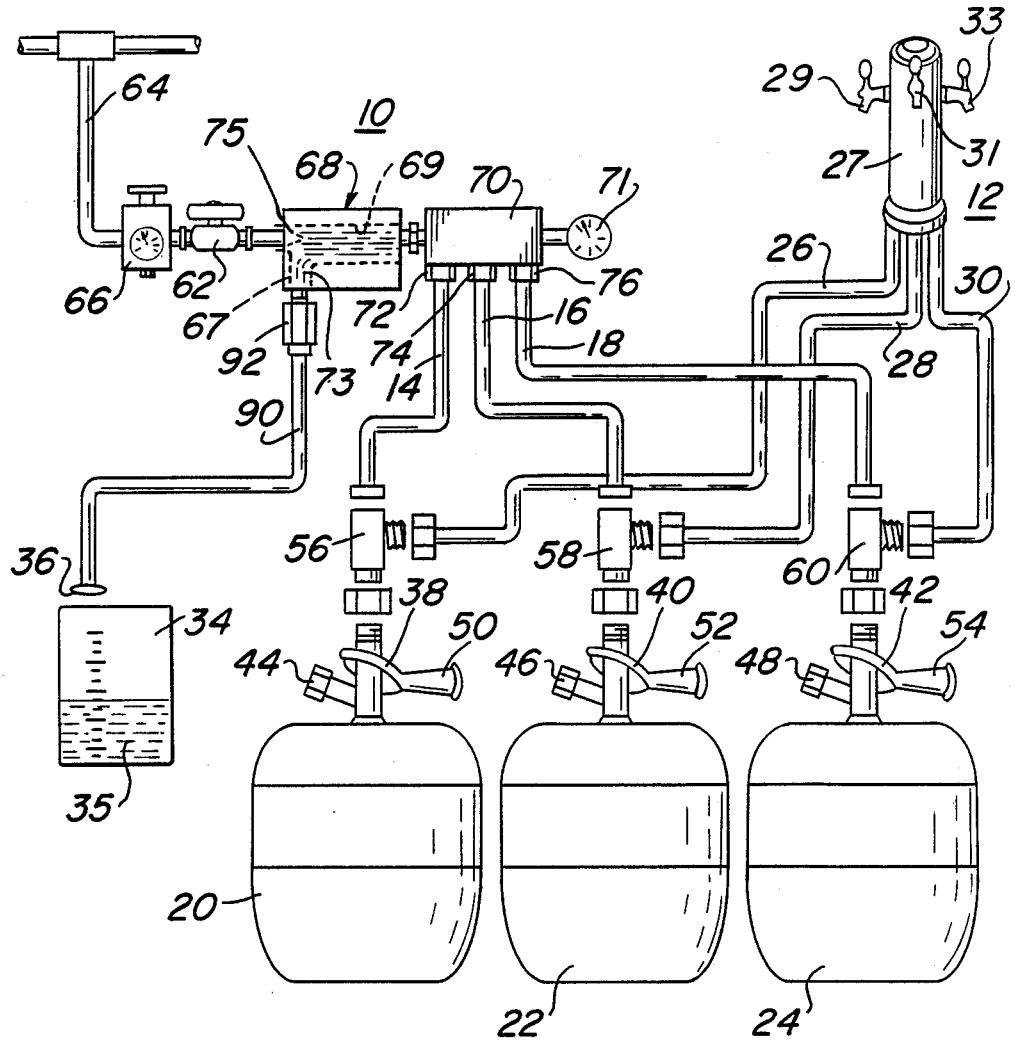
FIG. 1 illustrates one embodiment of a cleaning system for selectively cleaning conduits in a beverage delivery system.

The present invention will be described in connection with a beer dispensing system in which beer is delivered from a plurality of taps on kegs to one or more spigots located in a place where customers are generally assembled in a tavern, for example. Generally the present invention involves valve mechanisms for selectively switching between cleaning and beer dispensing operations.

In practicing the present invention, a cleaning system 10 is connected to a liquid or beer dispensing system 12, for example. The cleaning operation will be described in connection with such a beer dispensing system. The cleaning system 10 is connected to the dispensing system 12 through conduits 14, 16 and 18. Pressurized water with a cleaning solution, as will be described, is connected to the conduits 14, 16 and 18 during a cleaning operation.

During a normal beer dispensing operation, beer is dispensed from beer kegs 20, 22 and 24 which are connected to have beer forced through conduits 26, 28 and 30 with no pressurized water with cleaning solution being applied to the conduits 14, 16 and 18. During a cleaning operation, however, the dispensing operation is switched to a cleaning operation. At this time, no beer is allowed to flow from kegs 20, 22 and 24 through lines 26, 28 and 30 to spigots 29, 31 and 33. A housing structure 27 receives the conduits 26, 28 and 30 leading to the spigots 29, 31 and 33. Means are provided to selectively switch from the cleaning operation to the beer dispensing operation, and vice versa.

A container 34 is provided for holding a cleaning solution 35 therein. The cleaning solution 35 may comprise, in the embodiment of the invention illustrated, a mixture of a chemical comprising powder mixed with water, with the powder being, for example, a product identified as Perlick Direct Draw Cleaner Compound, manufactured by The Perlick Corp. of Milwaukee, Wis. The water is mixed in predetermined amounts with predetermined amounts of water to form the cleaning solution. The concentration of the chemical powder mixed with the water depends upon the particular cleaning operation involved and the nature of the dispensing system being cleaned. The container 36 may include a quick disconnect cap 36 and include a suitable vent (not illustrated) which allows air from the container 36 to enter as the solution 35 in the container is used.

The beer kegs 20, 22 and 24 normally include beer under pressure except when they are empty and require replacement. Conventional valves 38, 40 and 42 are connected to the kegs 20, 22 and 24, respectively. A source of carbon dioxide gas ($CO_2$) not illustrated, is connected to the kegs 20, 22 and 24 through connectors 44, 46 and 48. Handles 50, 52 and 54 are manually operated to open or close valves so that beer from the kegs 20, 22 and 24 either passes through or is blocked by the valves 38, 40 and 42. When any of the beer kegs 20,22 or 24 are empty, its respective valve 38, 40 or 42 is closed to permit the placement of a new full keg. The valves 38, 40 and 42 may be of the type known as Sankey manufactured by many manufacturers. The use of Sankey valves make it possible to perform a cleaning operation without disconnecting the the kegs. Other types of tapping valves may require the kegs to be disconnected prior to cleaning.

Shuttle valves 56, 58 and 60 are connected to the valves 38, 40 and 42, respectively. In a preferred embodiment of the invention, the shuttle valves 56, 58 and 60 are permanently installed on the valves 38, 40 and 42 leading to the beer kegs 20, 22 and 24 as a safety precaution and to prevent cleaning solution and beer from being mixed during dispensing of beer.

FIG. 2 illustrates a cross sectional view of shuttle valve 56. The valve 56 includes an inlet connector 57 which may receive the conduit 14 thereon. A connector 59 including multiple parts, is connected to the valve 38 leading to the keg 20. An outlet connector 55 is connected to conduit 26. The three connectors 57, 59 and 55 lead to a common open area which includes a movable ball 61. The ball 61 is disposed to be moved either against "O" ring 65 to block the opening from the connector 57 or against the "O" ring 63 to block the opening leading to connector 59. Thus the pressure of the cleaning solution at connector 57 will block the beer flow from connector 59 as the cleaning solution flows through the connector 58. Likewise when the beer is flowing the pressure of the beer closes the opening to connector 57 and prevents cleaning solution from flowing when beer is dispensed through connector 55.

The shuttle valves 58 and 60 operate in a manner similar to shuttle valve 56. Thus the shuttle valves 56, 58 and 60 act to automatically switch from a cleaning operation to a beer dispensing operation.

The shuttle valves may be of the types known as a Pneu-trol Shuttle valve, made by Deltrol Mfg. Co.

Referring again to FIG. 1, semi-permanently mounted shuttle valves 56, 58 and 60 eliminate the need for disassembly of beer lines 26, 28 and 30 for cleaning during a cleaning operation. The shuttle valves 56, 58 and 60 are modified 3-way valves which permit them to be normally closed during the dispensing of beer to prevent cleaning fluid from passing through the conduits 14, 16 and 18 while beer flows through conduits 26, 28 and 30. During a cleaning operation however, the valves 56, 58 and 60 operate close to shut off the beer from passing to conduits 26, 28 and 30. At the same time, the cleaning conduits 14, 16 and 18 open to cleaning solution with pressurized water therethrough.

When the dispensing system 12 is ready for cleaning, the shuttle valves 56, 58 and 60 are automatically operated to discontinue the flow of beer from the kegs 20, 22 and 24 to the beer line conduits 26, 28 and 30. The spigots 29, 31 and 33 are manually opened by an operator, which may be a bartender. It is assumed that the container 34 includes the cleaning solution 35 required for the particular system involved. To start the cleaning operation, the operator turns on a water valve 62 to permit pressurized water to flow from a supply line 64 through a pressure regulator 66 to a mixing valve 68 which may be considered a "venturi" device. The water source supply line is generally a permanently connected supply pipe in a tavern or other establishment. The pressure regulator 66 is used to prevent over pressuring the cleaning system and may, for example, be set so that no more than 50 psi water pressure can enter the cleaning system.

When pressurized water is flowing through valve 68 or venturi device, portions of the cleaning solution 35 from the container 34 is applied through a flexible connecting tubing 90, through a one-way check valve 92, to the mixing venturi device 68. The pressurized water flow through device 68 causes part of concentrated cleaning solution 35 to be siphoned from the container 34 and mixed with the water originating from the source 64. The water flowing through the mixing valve 68 is applied through a manifold 70 to the shuttle valves 56, 58 and 60.

Venturi device 68 includes paths or openings 67 and 69 therein, represented by dotted lines. The opening 69 receives therethrough the flowing water 75 and the opening 67 receives therethrough the cleaning solution 73 the opening 67 may be considered a suction port. The cleaning solution represents a small portion of the solution 35 from the container 34. The pressurized water 75 creates a venturi effect to cause the cleaning solution to be suctioned from the container and be mixed with the water. The manifold 70 is provided with attachment means 72, 74 and 76 for connecting conduits 14, 16 and 18 to the shuttle valves 56, 58 and 60 which lead to the beer delivery conduits 26, 28 and 30.

During a cleaning operation, the flowing pressurized water from source 64 is mixed with the chemical solution 35 from the container 34 and passes through the cleaning conduits 14, 16 and 18, through shuttle valves 56, 58 and 60, through beer dispensing conduits 26, 28 and 30 and finally out of the open spigots 29, 31 and 33. The amount of cleaning solution 35 mixed with the pressurized water is proportional to the pressure of the water at the point or area at the manifold 70 leading to the conduit 14, 16 and 18. Back pressures at this point affect the water pressures to control the amount of cleaning solution applied during the cleaning operation. Greater back pressure results in less amounts of cleaning solution being applied from the container. In like manner, less back pressure results in more cleaning solution being applied.

A vacuum or venturi effect in device 68 achieves its maximum performance with a large pressure differential between the incoming pressure of P1 entering the manifold 70, versus outgoing pressure of P2 at the output of the manifold 70. As resistance is encountered at the output by conduits, the pressure differential or $\Delta P$ is reduced, as is amount of vacuum the venturi is able to generate within the device 68. When the suction or vacuum part of the device 68 is connected to the container 34 the amount of cleaning fluid drawn into the suction port 67 of the venturi device 68 will be reduced as the resistance is increased. The use of venturi effects are broadly known.

When the shuttle valves 56, 58 and 60 are open, water from source 64 enters the venturi device 68. The venturi device 68 may be a modified air operated vacuum generator manufactured by Protech, Inc. of Marblehead, Mass. The venturi device 67 has been modified to achieve maximum vacuum at its suction port 67 when subjected to a wide range of system back pressures or restrictions at the outlets. Those skilled in the art or a manufacturer of water operated venturis recognize that the internal orifice diameters and other known factors effect results achieved.

After one or more spigots 29, 31 and 33 is opened, water is allowed to flow rapidly through the venturi device 68 and a low pressure condition is created at the suction port. It is for this reason that the concentrated cleaning solution 35 in the solution container 34 is drawn up the suction tube 70 and through the one-way check valve 72 into the venturi device 68 where the solution throughly mixes with the incoming water supply as a result of the great amount of turbulence inside the venturi device 68. The concentrated cleaning solution becomes diluted with the incoming water to achieve a level of concentration necessary to provide maximum cleaning and maximum economical use of the chemical powder in the solution.

To assure adequate water pressure for producing the venturi effect, all the spigots are not opened at the same time. One or two spigots may be opened dependent upon the pressures measured by gauge 71. When the cleaning solution is in all of the conduits, it is desirable to close all the spigots 29, 31 and 33 and permit the cleaning solution to penetrate, loosen or dissolve undesirable particles in the lines.

The chemical powder in the solution 35 may be a caustic soda compound or other suitable material. The concentration of the powdered chemical, the amount of time that the cleaning solution mixture is allowed to remain in the beer lines and other factors determine the effectiveness in dissolving accumulated yeast and other particles in the beer lines. This accumulation of particles is known as "beerstone", which can seriously affect the flavor of the beer if not removed at periodic intervals.

After a required amount of cleaning solution is dispensed from the spigots 29, 31 and 33, the cleaning solution in the container 35 will generally be empty. Clear rinse water will then be present in the system during the cleaning operation. Thus the cleaning system automatically changes from water with cleaning solution to clear rinse water. The operator generally dispenses a sufficient amount of clear rinse water from the spigots to insure removal of all traces of the cleaning solution from the beer lines.

The amount of resistance is the lines or conduits of a typical draft beer system can be influenced by three main factors including the diameters of the tubing used, the lengths of the tubing and gravity or lift resistance.

With respect to the internal diameters, five different internal diameters have been used. These include: 3/16" I.D. tubing, having 2.2 lbs. resistance per ft.; ¼" I.D. tubing having 0.85 lbs. resistance per foot; 5/16" I.D. tubing having 0.40 lbs. resistance per foot; ⅜" I.D. tubing having 0.20 lbs. resistance per foot; and ½" I.D. tubing having 0.025 lbs resistance per foot. The lift resistance or may be gravity × ½ lb. per foot of vertical rise. The resistance is based on 1 gal. flow per minute.

Because resistance back pressure effects the amount of cleaning solution drawn into the system by the venturi effect previously discussed. A pressure gauge 71 is connected on the manifold 70 at the output of the venturi device 68. The pressure readings at the gauge 71 assists in determining the amount of cleaning solution entering the conduits 14, 16 and 18. These readings may be used to vary the concentration of the cleaning solution 35. For example, the ratios of the chemical powder and the water may be either increased or decreased for maximum cleaning effectiveness. A color-coded dial on the gauge 71 may be used to indicate cleaning solution concentrations instead of indicating back pressures in standard units such as P.S.I. The venturi effect in the system described is one which will tolerate an excessive amount of back pressure and still generate a vacuum.

With an input water pressure of 40 psi venturi device 68 will generate vacuum until a back pressure of 15 psi is reached. On a multiple tap system assuming excessive resistance caused by long tubing of small diameter with a high rise, for example, opening one of the spigots 29, 31 or 33 with the unit on may indicate a back pressure of 20 psi. The venturi device 68 may not generate sufficient vacuum to introduce cleaning solution into the system. Under these conditions opening two spigots simultaneously will reduce the back pressure on the venturi device to enable it to generate vacuum. Because the cleaning solution lines are connected to a common manifold 70, each solution line can be treated as a resistor in parallel.

In one example, if one spigot is opened and the gauge 71 may indicate 20 psi back pressure. When two spigots are opened, the gauge 71 may read 10 psi and the venturi device 68 will be effective to draw solution into the water. If three spigots are opened simultaneously, the gauge 71 may read 6.6 psi to introduce still more cleaning solution into the water.

It is recognized that the total amount of cleaning solution is dependent upon the number or conduits involved, the size of the system and other factors. The concentration of the solution, i.e., the amount of chemical powder mixed with water is dependent upon the back pressures involved.

To provide a visual indication of whether or not a cleaning chemical mixed with water or rinse water is in the system, in practicing the present invention, the chemical powder included a blue coloring agent to minimize any mistake regarding the presence of the cleaning solution.

When different tapping valves are used, it is generally necessary to disconnect the kegs before starting a cleaning operation. To operate these systems the operator first connects a solution container containing only water to the suction line 90 from the venturi device 68. It is necessary to remove the taps from the kegs 20, 22 and 24. When this is done, the pressure at the beer input lines 26, 28, 30 connected to the shuttle valves 56, 58 and 60 is at atmospheric pressure. The shuttle valves allow the water to enter the system. When the spigots are opened water will be dispensed and the operator would then take a reading of his system back pressure at the pressure gauge 71. If the back pressure on the gauge 71 is excessive (over 0.375 × input pressure), the venturi effect in the valve 68 will not achieve enough vacuum to lift the solution 35 from the solution container 34 to introduce it into the system. This can be remedied and the venturi effect can be made to operate more efficiently by opening an additional spigot to lower the system back pressure and result in a lower gauge reading within the working limits of the venturi.

Because the spigots are connected to the device through a common manifold 70, the resistance of each beer line may be compared electrically as resistors in parallel where:

$$\frac{1}{R_1} = \frac{1}{R_1} + \frac{1}{R_2} + \frac{1}{R_3} + \cdots$$

After the back pressure of the system is determined by the operator, he can then consult the solution chart FIG. 3 and mix the amount of solution for each conduit to be cleaned at the required concentration to achieve maximum cleaning for their system.

After approximately ½ gallon of cleaning solution is dispensed from each spigot, the concentrated cleaning solution container will generally be empty and now the operator will observe clear rinse water dispensing from the spigots 29, 31 and 33. It is desirable to dispense at least ½ gallon of clear rinse water before checking the rinse water for a neutral Ph factor to ensure that even trace amounts of cleaning chemical have been removed from the system.

To deactivate the cleaning operation and return to the dispensing operating of beer, the two way valve 62 is closed to interrupt the flow of water into the system. Retapping the kegs and opening spigots causes the pressurized beer to force the remaining water in the beer lines 26,28 and 30 out of the spigots.

Referring to FIG. 3, a chart illustrating the venturi performance for different back pressures in a particular system. The vertical scale indicates the amount of cleaning solution involved and the horizontal scale indicates the back pressure readings at gauge 71.

When the readings of the gauge 71 indicates 4 or 6 psi, the amounts of cleaning solution may be about 23 and 21 ounces, respectively for two measurements of chemical per spigot. For gauge indications of 8 or 10 psi three measurements of the chemical would be used with 16 and 12 ounces of cleaning solution. For 12 or 14 psi, 4 measurements will be used with 9 and 5 ounces of cleaning solution. The solution per spigot assumes one half gallon of water with solution collected.

The cleaning system illustrated is adaptable for use involving different numbers of conduits in a dispensing system. Basically, the gauge 71 is used to measure the back pressure resulting from the connections of the plurality of conduits in the system. The back pressure will normally be determined by the number of conduits involved, the length of the conduit, the pressure of the water mixed with the chemical and various other factors in the system. When the back pressure is known or determined, this will provide an indication of the amount of chemical in the cleaning solution which is necessary to perform an efficient operation. Also, the pressure readings provide information for changing the ratios or concentration of a chemical powder with respect to the water with which it is mixed to produce to cleaning solution.

When a cleaning system is first installed, the cleaning apparatus will be connected and the water pressure leading to the conduit in the systems is measured by the gauge 71. The particular amount or ratio of the chemical with respect to the water in the container 34 may be determined from the water pressure reading. After the installation with the cleaning solution properly proportioned, an efficient cleaning operation can be performed. The only reason for changing the amount of concentration of the chemical in the container 34 will be if the dispensing system itself is varied. Consequently, it is seen that the equipment for cleaning does not change for different systems. The only thing that needs to be changed is the mixture of the chemical cleaning solution in the container 34.

What is claimed is:

1. In combination with a beverage delivery system for delivering a beverage for a beverage source through conduits to a dispenser, an automatic cleaning system connected to said beverage delivery system to permit selective cleaning of said conduits comprising:

a. A source of pressurized water, b. Multiple shuttle valves connected to said conduits for selectively connecting said beverage source to said dispenser through said conduits to permit beverage to be dispensed during a normal operation of said beverage delivery and to block the passage from said beverage source to said conduits during said cleaning operation, c. a source of cleaning solution, d. means for selectively connecting said pressurized water to cause water to flow through said conduits and said dispenser during said cleaning operation, e. means connecting said source of cleaning solution to cause a predetermined amount of cleaning solution to be mixed with the water flowing through said conduits, f. said predetermined amount of cleaning solution corresponding to the pressure of the water entering said conduits, and g. means to measure the pressure of the water and the cleaning solution entering the conduits during the cleaning operation, the means to measure the pressure comprising a pressure gauge which provides information to effect a change of concentration of the cleaning solution.

2. An automatic cleaning system as set forth in claim 1 wherein said cleaning solution comprises a mixture of chemical powder and water, with the amount of powder used being dependent upon the concentration required to provide an efficient cleaning operation.

3. An automatic cleaning system as set forth in claim 2 wherein said source of beverage comprises a keg of beer connected to a source of pressurized gas during normal operation.

4. An automatic cleaning system as set forth in claim 3 wherein a keg tapping valve is connected between said shuttle valve and said keg to permit said source of pressurized gas to be applied to said keg when said keg tapping valve is in a first position during normal operation and to a second position to block the flow of said gas during a replacement of said keg with another keg.

5. An automatic cleaning system as set forth in claim 4 wherein said shuttle valve is connected to said keg tapping valve to permit said conduits to be cleaned without disassembly from the beverage delivery system.

6. An automatic system as set forth in claim 5 wherein said shuttle valve is operative to prevent the pressurized water from entering said keg of beer during a cleaning operation.

7. An automatic cleaning system as set forth in claim 6 wherein the pressure of the water flowing from said source creates a venturi effect to siphon portions of said cleaning solution into said water flowing in an amount corresponding to said pressure.

8. An automatic cleaning system as set forth in claim 7 wherein said cleaning solution includes an ingredient for coloring said water when a cleaning operation is taking place, with said water becoming clear during a rinsing operation after the application of the cleaning solution to the water flowing cleaning solution has been discontinued.

* * * * *